United States Patent [19]

Poole

[11] Patent Number: 5,029,767

[45] Date of Patent: Jul. 9, 1991

[54] ROLL HOLDING FIXTURE WITH INSERT

[75] Inventor: Daniel L. Poole, Paradise Valley, Ariz.

[73] Assignee: Designer Bathware, Inc., Phoenix, Ariz.

[21] Appl. No.: 418,529

[22] Filed: Oct. 10, 1989

[51] Int. Cl.[5] ..... B65H 19/04

[52] U.S. Cl. ..... 242/55.2; 242/55.53

[58] Field of Search ..... 242/55.2, 55.3, 55.53; 312/242; 248/27.1

[56] References Cited

U.S. PATENT DOCUMENTS

| | | | |
|---|---|---|---|
| 2,767,945 | 10/1956 | Bragg | 248/231.9 X |
| 3,863,872 | 2/1975 | Godes | 248/27.1 |
| 4,274,330 | 6/1981 | Witten et al. | 248/27.1 X |
| 4,553,710 | 11/1985 | Pool | 242/55.2 |
| 4,685,035 | 8/1987 | Nanjoh | 248/27.1 X |

*Primary Examiner*—Daniel P. Stodola
*Assistant Examiner*—P. Bowen
*Attorney, Agent, or Firm*—Don J. Flickinger; Jordan M. Meschkow

[57] ABSTRACT

A fixture for holding and dispensing coiled sheet material, such as tissue paper or paper towels, is disclosed. A base mounts upon a mounting wall and is configured as a perimeter which surrounds a base opening. The base includes support arm mounts located on opposing sides of the base opening. Support arms attach to the support arm mounts and couple to the roll of sheet material to hold and aid in dispensing the sheet material. An insert is dimensioned conformal with and slightly smaller than the base opening. The insert fits through the base opening and extends into the interior of the mounting wall. A flange of the insert abuts against a portion of the base to prevent movement of the insert beyond the base. In addition, the support arms are dimensioned to overlie portions of the insert so that the insert is secured in position by being clamped between the base and support arms.

1 Claim, 1 Drawing Sheet

FIG. 1
PRIOR ART
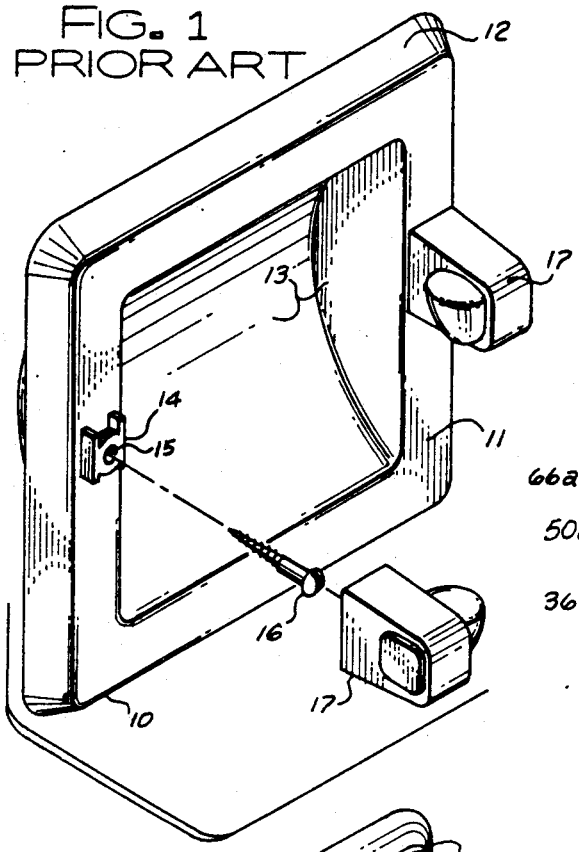
FIG. 3
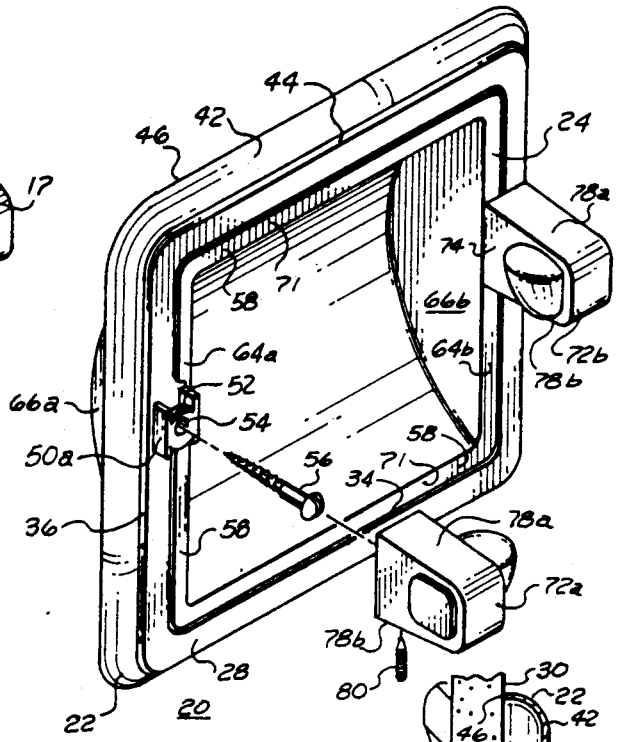
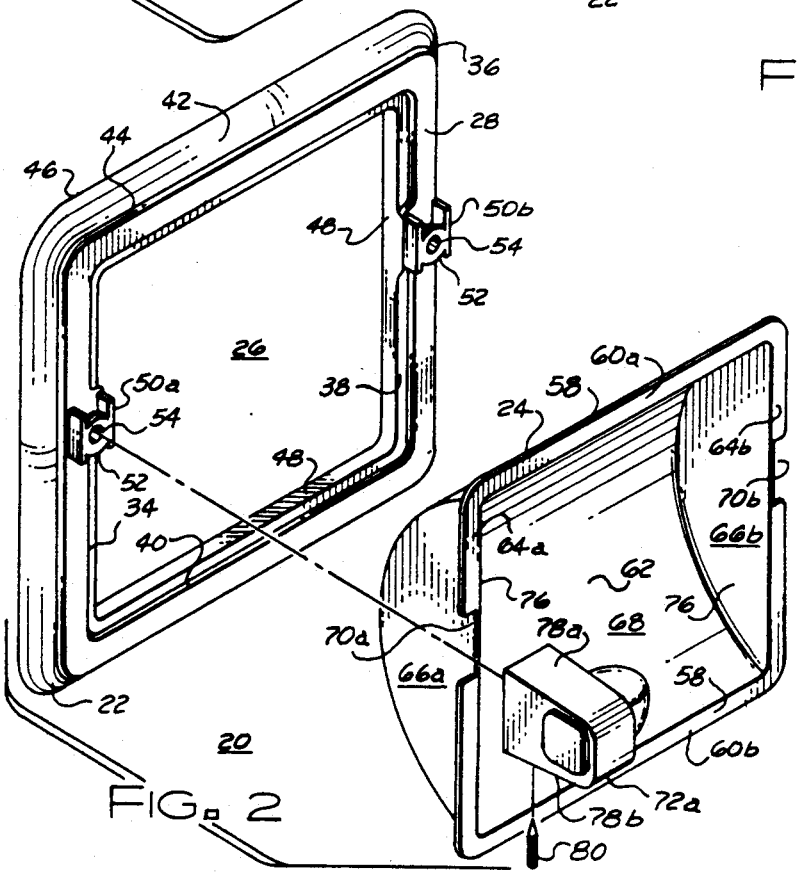
FIG. 2
FIG. 4
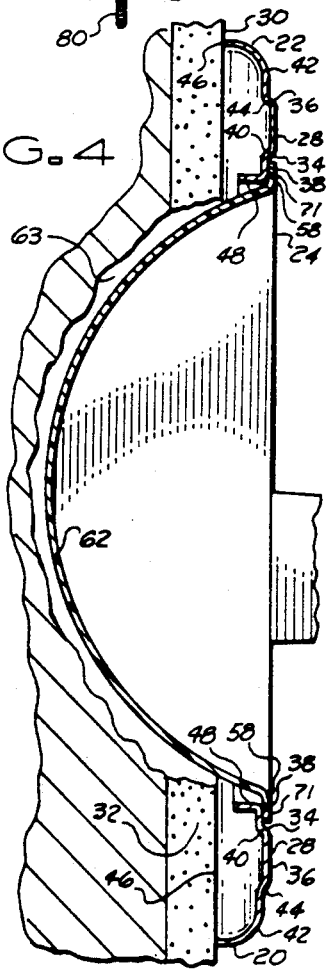

ROLL HOLDING FIXTURE WITH INSERT

TECHNICAL FIELD OF THE INVENTION

The present invention relates generally to holding and dispensing fixtures. Specifically, the present invention relates to devices for rotatably supporting a cylindrical roll of coiled sheet material, such as paper towels, toilet tissue, and the like. More specifically, the present invention relates to such devices which mount upon and include recessed structures which project into hollow walls, doors, ceilings, overhangs, and the like.

BACKGROUND OF THE INVENTION

Many different products are packaged and distributed as rolls of sheet material. Such sheet material is coiled about a typically hollow core, usually a cardboard tube. In addition, such sheet material is frequently perforated to define readily separable sheets of the material. Toilet tissue and paper towels are well known exemplary products. Wrapping paper, wax paper, metal foil, and plastic sheets represent other examples.

The prior art includes many types of devices for holding and dispensing such sheet material. These fixtures are commonly found in residential and commercial kitchens and bathrooms. Such fixtures usually attach to a suitable and convenient surface, such as a wall, the underside of a shelf, or the backside of a door. One type of prior art fixture is disclosed in U.S. Pat. No. 4,553,710, entitled "Roll Holding Fixture," and issued to the inventor of the present invention. U.S. Pat. No. 4,553,710 is incorporated herein by reference.

As shown in FIG. 1 herein, the prior art fixture also described in U.S. Pat. No. 4,553,710 includes a base 10 having an integrally formed exterior surface 11, a tapered surface 12, and a recessed surface 13. Support arm mounts 14 rigidly attach to base 10 and have holes 15 therein so that base 10 can mount upon a mounting member (not shown), such as a wall, door, ceiling, overhang, or the like, using screws 16. Support arms 17 couple to mounting supports 14 to hide screws 16 from view and to rotatably couple to a roll of sheet material (not shown). When mounted to the mounting member, recessed surface 13 of base 10 extends into the interior of the mounting member while exterior and tapered surfaces 11 and 12, respectively, reside outside of the mounting member.

While this prior art fixture has achieved a degree of commercial success, it has nevertheless presented heretofore unanswered problems. For example, the base 10, which includes integrally formed exterior, tapered, and recessed surfaces 11, 12, and 13, respectively, has proven undesirably expensive to manufacture. In order to achieve the desired surface shapes and the strength needed to remain attached to the mounting member while being subjected to external forces applied during dispensing operations, base 10 has been stamped from a suitable metal. Thus, the materials from which base 10 has been formed have been undesirably expensive. In addition, recessed surface 13 has been difficult to polish in preparation for applying a desired surface finish, such as paint or an anodized film. This difficulty has further increased costs associated with base 10.

Moreover, roll holding fixtures often serve a decorative role in addition to their roll holding and dispensing functions. As decorative items, a fixture's aesthetic value increases if the fixture can be provided with a variety of color schemes. However, the costs associated with manufacturing multiple color versions of the above-discussed prior art fixture have been prohibitive due to the integral construction of base 10. In addition, the stocking and distribution costs of maintaining an inventory of all possible color combinations is exponentially greater than the costs associated with stocking and distributing single color fixtures. Consequently, the above-discussed prior art fixture has failed to achieve its decorative potential.

SUMMARY OF THE INVENTION

Accordingly, it is an advantage of the present invention that an improved roll holding fixture which utilizes an insert for a recessed surface is provided.

Another advantage of the present invention is that a roll holding fixture which is relatively inexpensive to manufacture is provided.

Yet another advantage is that the present invention provides a roll holding fixture which can easily be manufactured, distributed, and stocked while providing a consumer with a multiple color fixture chosen from a wide variety of color combinations.

The above and other advantages of the present invention are carried out in one form by a fixture which attaches to a mounting surface having a cavity therein. The fixture holds a roll of coiled sheet material. The fixture includes a base, an insert, and first and second support arms. The base has an opening, and the base is adapted to be mounted upon the mounting surface near the mounting surface cavity. The insert is configured to be removed from the base and to be inserted into the mounting surface cavity in alignment with the opening of the base. The first and second support arms couple to the base at opposing sides of the opening. The first and second support arms hold the roll.

BRIEF DESCRIPTION OF THE DRAWINGS

A more complete understanding of the present invention may be derived by referring to the detailed description and claims when considered in connection with the FIGURES, wherein like reference numbers refer to similar items throughout the FIGURES, and:

FIG. 1 shows a prior art roll holding fixture;

FIG. 2 shows a perspective view of the present invention with an insert of the present invention removed from a base of the present invention;

FIG. 3 shows a perspective view of the present invention with the insert installed in the base; and FIG. 4 shows a cross-sectional side view of the present invention mounted upon a mounting member.

DETAILED DESCRIPTION OF THE PREFERRED EMBODIMENT

FIG. 1 shows a prior art roll holding fixture in which a recessed surface portion 13 is integrally formed with a base 10 of the roll holding fixture. This integral base and recessed surface assembly produces numerous problems, which are discussed above.

FIGS. 2–4 show various views of a roll holding fixture 20 constructed in accordance with the present invention. As depicted in FIG. 2, roll holding fixture 20 includes a base 22 and an insert 24 which are separable from one another. However, as illustrated by FIGS. 3 and 4, insert 24 mates with base 22 so that insert 24 serves the functions provided by recessed surface 13 in the prior art fixture of FIG. 1.

Specifically, base 22 exhibits a generally square shape configured as a perimeter which surrounds a generally square shaped base opening 26. As best illustrated in FIG. 4, base 22 has an generally planar exterior surface 28 which substantially parallels and is spaced apart from a mounting surface 30 of a mounting member 32 when base 22 is mounted upon mounting member 32. An inward side 34 of exterior surface 28 faces opening 26, and an outward side 36 of exterior surface 28 opposes inward side 34. Base 22 exhibits a stepped construction so that a generally planar flange support surface 38 substantially parallels and is spaced toward mounting surface 30 from exterior surface 28 at inward side 34 by a riser 40. Flange support surface 38 resides adjacent to base opening 26. Likewise, a tapered or curved surface 42 is spaced toward mounting surface 30 from exterior surface 28 at outward side 36 by a riser 44. Tapered surface 42 tapers or curves from riser 44 toward mounting surface 30 and terminates at a contacting edge 46 of tapered surface 42. Contacting edge 46 defines a plane around the perimeter of base 22 which contacts mounting surface 30 when base 22 is mounted upon mounting member 32. In the preferred embodiment, an inside surface 48 extends perpendicularly inward from an interior side of flange support surface 38 toward mounting surface 30. However, inside surface 48 extends only a short distance and does not contact mounting surface 30. Thus, when mounted upon mounting member 32, only contacting edge 46 contacts mounting surface 30 while other surfaces of base 22 are positioned outward from mounting surface 32.

Left and right support arm mounts 50*a* and 50*b*, respectively, are immovably affixed to exterior surface 28 on opposing sides of opening 26. As illustrated best in FIGS. 2 and 3, riser 40 and flange support surface 38 are discontinued in the vicinities of support arm mounts 50*a*–50*b* so that exterior surface 28 extends to inside surface 48. Consequently, support arm mounts 50*a*–50*b* reside near inside surface 48. Each of support arm mounts 50*a*–50*b* includes a cone-shaped frustum 52 or inclined surface located so that the base of frustum 52 projects outward from exterior surface 28. A mounting hole 54 extends through the central area of frustum 52 and through base 22 so that a screw 56 (see FIG. 3) may be inserted therethrough for mounting base 22 upon mounting member 32 in a conventional fashion.

In the preferred embodiment, base 22 is stamped from a suitable metallic substance. Consequently, the strength needed to support and hold roll holding fixture 20 on mounting member 32 is provided. However, nothing prevents base 22 from being manufactured from a suitable wood or plastic material provided that base 2 remains firmly attached to mounting member 32 and to support arms (discussed below).

Insert 24 includes a substantially planar flange 58 conformally dimensioned to flange support surface 38 of base 22. An interior edge of each of top and bottom sides 60*a* and 60*b* of flange 58 adjoins a concave, recessed wall 62. As illustrated in FIG. 4, wall 62 extends into a cavity or hollow portion 63 within the interior of mounting member 32 when fixture 20 is mounted upon mounting member 32. Interior edges of each of left and right sides 64*a* and 64*b* of flange 58, adjoin left and right side walls 66*a* and 66*b*, respectively. Left and right side walls 66*a* and 66*b*, respectively, extend perpendicularly from flange 58 to concave wall 62. Thus, insert 24 defines an enclosed space which is accessed by an insert opening 68 located at a plane defined by flange 58.

In addition, left and right sides 64*a* and 64*b* of flange 58 include cut-out portions 70*a* and 70*b*, respectively. Cut-out portions 70*a*–70*b* accommodate support arm mounts 50*a*–50*b*, respectively. Specifically, insert 24 mates with base 22 as illustrated by FIGS. 3–4. Insert 24 is dimensioned so that a cross section of insert 24 defined by the intersection between flange 58 and walls 62, 66*a*, and 66*b* conforms to and is slightly smaller than base opening 26 (see FIG. 2). Consequently, insert 24 fits into and through base opening 26 until flange 58 abuts flange support surface 38 of base 22. As a result, insert 24 is aligned with base opening 26.

As discussed above, flange support surface 38 is interrupted in the vicinities of support arm mounts 50*a*–50*b*, wherein exterior surface 28 extends to interior side 48 of base 22. Cut-out portions 70*a*–70*b* of flange 58 compensate for this interruption in flange support surface 38 so that flange 58 freely abuts flange support surface 38. Moreover, the thickness of flange 58 is mutually dimensioned with riser 40 of base 22 so that when insert 24 is inserted into opening 26 of base 22 an exterior surface 71 of flange 58 resides approximately coplanar with exterior surface 28 of base 22.

In the preferred embodiment, insert 24 is manufactured from a conventional plastic material using conventional injection or compression molding techniques. Thus, insert 24 may be made from a different, and preferably less expensive, material than is used for base 22.

As depicted in FIGS. 2–3, support arms 72*a* and 72*b* overlie and attach to support arm mounts 50*a*–50*b*, respectively. Accordingly, screw 56 and support arm mounts 50*a*–50*b* are hidden from view by support arms 72*a*–72*b*. Support arms 72*a*–72*b* couple to a roll of sheet material (not shown) in a conventional manner, an example of which is disclosed in the above-discussed U.S. Pat. No. 4,553,710. Thus, the cooperation of support arms 72*a*–72*b* and the roll of sheet material need not be discussed further herein.

However, support arms 72*a*–72*b* additionally attach to support arm mounts 50*a*–50*b* so that insert 24 becomes clamped between base 22 and support arms 72*a*–72*b*. As illustrated in FIG. 3, support arms 72*a*–72*b* are dimensioned so that an inward surface 74 of each of support arms 72*a*–72*b* extends approximately to an inside surface 76 of side walls 66*a*–66*b*. In addition, support arms 72*a*–72*b* are dimensioned so that top and bottom surfaces 78*a* and 78*b* of each of support arms 72*a*–72*b* extend over flange 58 of insert 24. Consequently, the installation of support arms 72*a*–72*b* on support arm mounts 50*a*–50*b* causes support arms 72*a*–72*b* to block movement of insert 24 out from opening 26 in base 22.

In addition, support arms 72*a*–72*b* attach to support arm mounts 50*a*–50*b* through the use of set screws 80. In the preferred embodiment of the present invention, set screws 80 have tapered points which ride against the tapered, inclined surfaces of frustums 52, discussed above. The direction of tapering or incline from a location distal from exterior surface 28 and hole 54 to a location proximate exterior surface 28 and hole 54 of frustums 52 causes support arms 72*a*–72*b* to be pulled inward, toward base 22, as set screws 80 are tightened. Consequently, this inward pulling applies a clamping pressure on flange 58 which tends to hold insert 24 securely in place without rattling. Furthermore, the approximately coplanar positioning of exterior surface 28 of base 22 and exterior surface 71 of flange 58 allows support arms 72*a*–72*b* to firmly clamp to both surfaces without exhibiting a loose or discontinuous attachment.

In summary, the present invention provides an improved roll holding fixture which utilizes a separable insert to provide a recessed surface which extends into a wall or other mounting member upon which the present invention may be mounted. This insert is manufactured from plastic using conventional plastic molding processes. Consequently, the materials used for the insert are relatively inexpensive. Moreover, a desired smoothness and coloring for the insert can be achieved in such conventional molding processes without additional polishing or finishing steps, and the entire manufacturing process for the insert remains inexpensive.

Since the base of the present invention does not include an integrally formed recessed surface, it requires less material, and less expensive polishing and finishing steps. Nevertheless, since only the base and not the insert attaches to the mounting member and attaches through support arms to the roll of sheet material, strength is maintained. Furthermore, both inserts and bases may advantageously be manufactured in an assortment of colors so that bases and inserts may be matched as desired to provide a multiple color fixture. Since inserts and bases are separate pieces, fewer components need be stocked to provide a consumer with a given assortment of color combinations than would be required for single piece fixtures.

The present invention has been described above with reference to a preferred embodiment. However, those skilled in the art will recognize that changes and modifications may be made in this preferred embodiment without departing from the scope of the present invention. These and other changes and modifications which are obvious to those skilled in the art are intended to be included within the scope of the present invention.

What is claimed is:

1. A fixture for attachment to a mounting surface and for rotatably holding a roll of coiled sheet material, said mounting surface having an exterior side and an interior side and defining a cavity, said fixture comprising:

(a) a base for mounting upon the exterior side of said mounting surface and for framing said cavity, said base defining a base opening for alignment with said cavity and including (i) an exterior surface for residing parallel to and spaced from the exterior side of said mounting surface, and (ii) a flange support surface located between said exterior surface and said cavity, said flange support surface being parallel to and recessed with respect to said exterior surface;

(b) an insert exhibiting a shape conformal to said base opening and residing within said base opening, said insert including a flange for abutment against said flange support surface; and (c) means for detachably coupling said insert to said base, said means comprising a pair of support arms removably attached to said exterior surface of said base on opposite sides of said base opening, each of said support arms having a first end for clamping said flange of said insert against said flange support of said base and a second end, projecting outwardly from said first end, for rotatably supporting an end of said roll of sheet material.

* * * * *